US006196100B1

(12) United States Patent
David et al.

(10) Patent No.: US 6,196,100 B1
(45) Date of Patent: Mar. 6, 2001

(54) DEVICE FOR CUTTING WIRE WINDINGS

(75) Inventors: Siegfried David; Karl Keller, both of Hilchenbach (DE)

(73) Assignee: SMS Schloemann-Siemag Aktiengesellschaft, Düsseldorf (DE)

( * ) Notice: Subject to any disclaimer, the term of this patent is extended or adjusted under 35 U.S.C. 154(b) by 0 days.

(21) Appl. No.: 09/291,074

(22) Filed: Apr. 14, 1999

(30) Foreign Application Priority Data

Apr. 17, 1998 (DE) ..... 198 17 035

(51) Int. Cl.[7] ..... B21F 11/00

(52) U.S. Cl. ..... 83/262; 83/167; 83/365; 83/371; 83/374; 83/451; 83/600; 83/602; 83/907; 140/140

(58) Field of Search ..... 83/907, 262, 950, 83/438, 373, 500, 374, 375, 380, 580, 167, 443, 449, 454, 491, 597, 600, 602, 694, 649, 75, 451, 72, 73, 359, 363, 368, 370, 371; 140/139, 140; 72/66, 129

(56) References Cited

U.S. PATENT DOCUMENTS 2,833,351 * 5/1958 Paton et al. ..... 83/443 X
3,400,623 * 9/1968 Reth et al. ..... 83/449 X
3,776,076 * 12/1973 Hauck ..... 83/580 X
3,850,204 * 11/1974 Hauck ..... 83/907 X
4,011,780 * 3/1977 David ..... 83/907 X
4,350,311 * 9/1982 Pokhodnya et al. ..... 83/907 X
4,449,435 * 5/1984 Colditz ..... 83/907 X

* cited by examiner

*Primary Examiner*—Boyer Ashley
(74) *Attorney, Agent, or Firm*—Friedrich Kueffner

(57) ABSTRACT

A device and a method for cutting a continuously travelling wire which emerges in the form of windings from a winding layer, wherein a cutting device arranged immediately following the winding layer. The cutting device includes a catching device for the targeted grasping of a winding arch and a device for cutting this winding arch. A device for controlling the sequence of movement of the catching and cutting devices are provided. The control takes place, for example, in dependence on the wire properties, such as, the wire diameter in the case of dimensional inaccuracies. In addition, the catching and cutting devices can be controlled in dependence on the position of operation of the winding layer.

9 Claims, 3 Drawing Sheets

DEVICE FOR CUTTING WIRE WINDINGS

BACKGROUND OF THE INVENTION

1. Field of the Invention

The present invention relates to a device and a method for cutting a continuously travelling wire which emerges in the form of windings from a winding layer.

2. Description of the Related Art

Wire is usually manufactured by rolling and drawing. After rolling, the wire travels through a winding layer and the wire windings are subsequently conveyed for cooling over a laying roller conveyor and a winding conveyor belt, and the windings are then combined into a coil through a feeding roller conveyor in a coil forming chamber with the use of a mandrel. The wire coil is then received by a hook.

The initial windings of a wire coil are scrap. The reason for this is a different cooling for the first windings which come into contact with the roller conveyors of the winding conveyor belt which are still cold, while the subsequent windings cool more uniformly. Undesired structural changes occur in the initial windings. Therefore, the initial windings are cut after having been transported over the winding conveyor belt, wherein the cut is carried out at the belt end, in the coil forming chamber or only at the hook. This does not pose a problem because the initial windings hang on the open side of the hook and, thus, are easily accessible.

Since the end of a wire coil is not dimensionally accurate, this end is also scrap. However, in contrast to the initial windings, the final windings within a coil are very difficult to reach. Therefore, it is only possible with great difficulties to cut and remove the final windings in the coil forming chamber or at the hook. This results in a manner of operation which is unsafe and susceptible to accidents and is very labor intensive.

SUMMARY OF THE INVENTION

Therefore, in view of the prior art discussed above, it is the primary object of the present invention to provide a device which operates quickly and precisely for cutting the wire windings which constitute scrap. In addition, a method for using the device is to be provided.

In accordance with the present invention, a cutting device is proposed which is arranged immediately following the winding layer.

The cutting device includes catching means for the targeted grasping of a winding arch and means for cutting this winding arch. Means for controlling the sequence of movement of the catching and cutting means are provided. The control takes place, for example, in dependence on the wire properties, such as, the wire diameter in the case of dimensional inaccuracies. In addition, the catching and cutting means can be controlled in dependence on the position of operation of the winding layer.

In using the proposed device, the final windings which constitute scrap material are no longer removed at the belt end, in the coil forming chamber or only at the hook, but rather they are removed immediately following the exit from the laying tube of a winding layer.

The cutting device according to the present invention has the following advantages.

Immediately following the winding layer, the wire windings are equally spaced from each other and the catching means can be moved precisely between the individual windings in order to separate the windings which constitute scrap from the windings which have the accurate dimensions.

The cutting point at the winding circumference can be adjusted in such a way that the end of the last dimensionally accurate wire winding can always be transported by pulling on the winding conveyor belt. This ensures an unimpeded transport of the wound wire over the roller conveyors without hooking of the final winding. Accordingly, the cumbersome and unsafe positioning at the wire end is no longer necessary.

In addition, the cut can be carried out at a right angle relative to the wire. The required cutting forces are not high because the wire still has a high processing temperature.

Since the laying roller conveyor begins immediately following the winding layer, the space between the two stations and the space underneath the laying roller conveyor can be used for removing the scrap material.

In accordance with a preferred embodiment, the catching means are composed of two catching arms which are arranged offset relative to each other as seen in the winding laying direction. The distance by which the two arms are offset corresponds to the angle of inclination of a wire winding. Consequently, these two arms form a type of catching fork for a winding arch.

In accordance with an advantageous feature, the two arms have an arc shape which corresponds to the curvature of a winding. The two arms are moved from outside underneath a winding arch and, thus, briefly form a support for a winding and, thus, a non-moving point of attack for the cutting means. The cutting means in the form of a shear acts on the winding arch at the location thereof which is not supported by the arms.

The shear is composed of an upper and a lower shear element. The upper shear element is mounted in such a way that it carries out a circular movement during which the lower shear element with the lower knife carries out an oscillating movement.

The catching arms and the shear can be controlled specifically with respect to the beginning and end of the movements thereof. This is achieved by means of respective drive systems which are controlled through sensors arranged in the process units, for example, the rolling train, in front of the winding layer or at the winding layer proper. Preferably, the sensors are photocells. If a dimensional inaccuracy of the wire diameter occurs, this inaccuracy is detected by the sensor and the movements of the catching arms and the shear are initiated.

The movement of the two catching arms preferably is an oscillating movement. The two arms oscillate toward each other and then again apart from each other. This is achieved by means of a crank and rocker system which is capable of converting a rotary movement into an oscillating movement.

The drive for this oscillating system can be decelerated and stopped after the smallest distance between the two catching arm ends has been reached in order to wait until the cutting process and the removal of the winding arches are concluded. However, when the cut windings drop down quickly, the oscillating movement is not interrupted.

The drive of the cutting element also is a crank and rocker system.

The drive of the driving block systems is effected by means of any type of motor, preferably an electric motor with a small inertia moment.

In accordance with a recommended feature, the upper arm is provided with a semicircular casing for catching the windings which are thrown outwardly.

A method of using the cutting device according to the present invention is also being proposed. In accordance with the method, the sequence of movement and the speed of the catching means for a winding arch and the cutting means are controlled in such a way that the catching means oscillate underneath a specific winding arch shortly after the winding arch emerges from the winding layer and the cutting means cut the winding arch which has been stabilized in this manner. The movements of the catching means and the cutting means start shortly one following the other.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
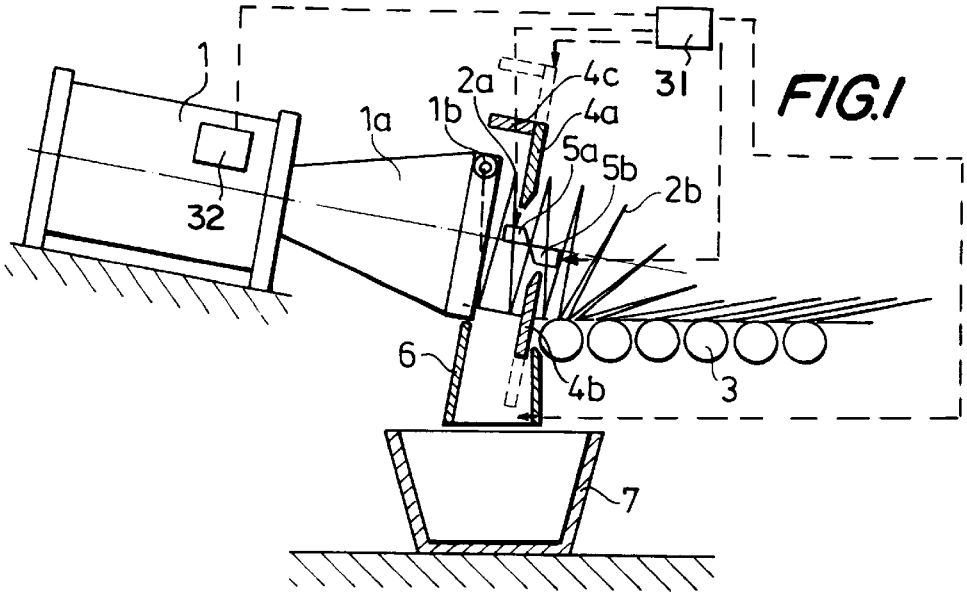
FIG. 1 is a schematic side view of an embodiment of the cutting device according to the present invention including the winding layer and laying roller conveyor.

FIG. 1 shows a winding layer 1 with a laying tube 1*a* and an exit 1*b*. After the wire has been processed, for example, in the rolling mill, the wire is placed into windings and is conveyed further in this form 2*a*, 2*b* on the laying roller conveyor 3 to the winding conveyor belt, not shown.

An upper catching arm 4*a* and a lower catching arm 4*b* are located between a winding arch. The upper and lower shear elements are schematically illustrated in the drawing and denoted by reference numerals 5*a*, 5*b*. The catching arms 4*a*, 4*b* and the shear elements 5*a*, 5*b* are arranged directly following the laying tube 1*a* of the winding layer 1. The cut wire scrap drops through the drop chute 6 into a collection container 7. The drop chute 6 is located directly underneath the catching arms 4*a* and 4*b* and the shear elements 5*a*, 5*b*.

Arranged underneath the drop chute 6 may be a chopping machine, not shown, of conventional construction with helical knives.

Figure 2:
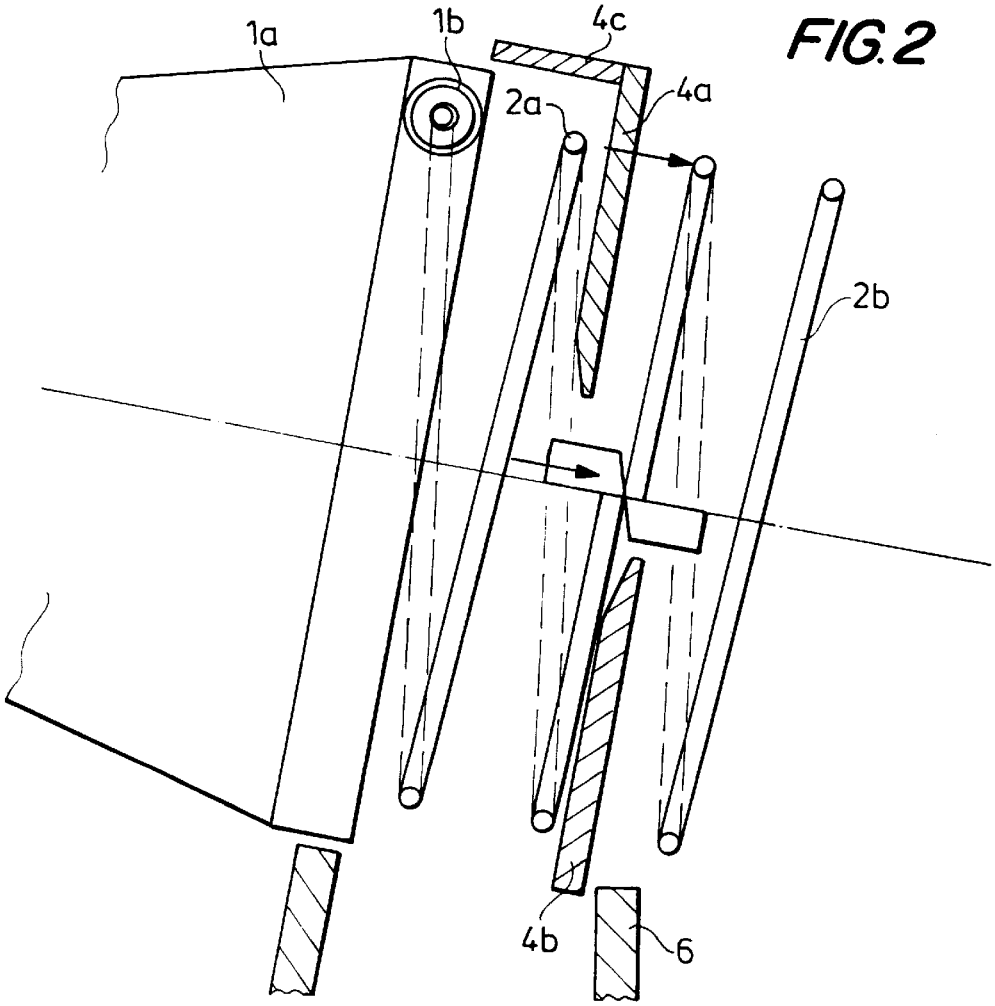
FIG. 2 is a side view, on a larger scale, showing a detail of FIG. 1.

The two catching arms 4*a*, 4*b* are arranged offset at a distance from each other, wherein the distance corresponds to the pitch or inclination of a winding arch, as seen in FIG. 2.

The catching arms are swung into a winding arch. The shear elements 5*a*, 5*b* act on that location of the wire which is not supported by the catching arms 4*a*, 4*b*. The speed of the shear corresponds to the speed of the wire which in this embodiment is 3 m/sec.

Figure 3:
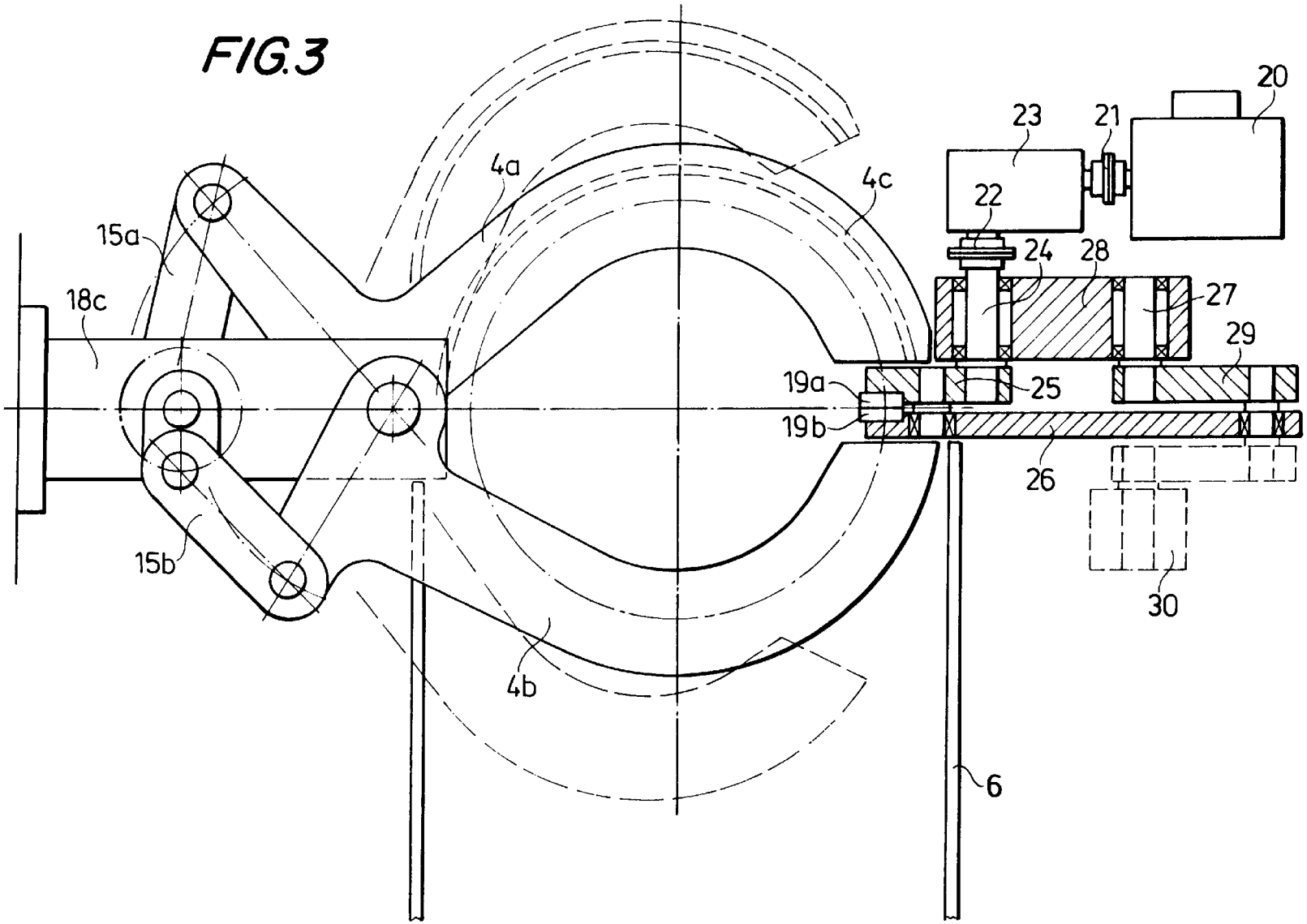
FIG. 3 is a top view of the cutting device as seen from the exit side of the winding layer.
Figure 4:
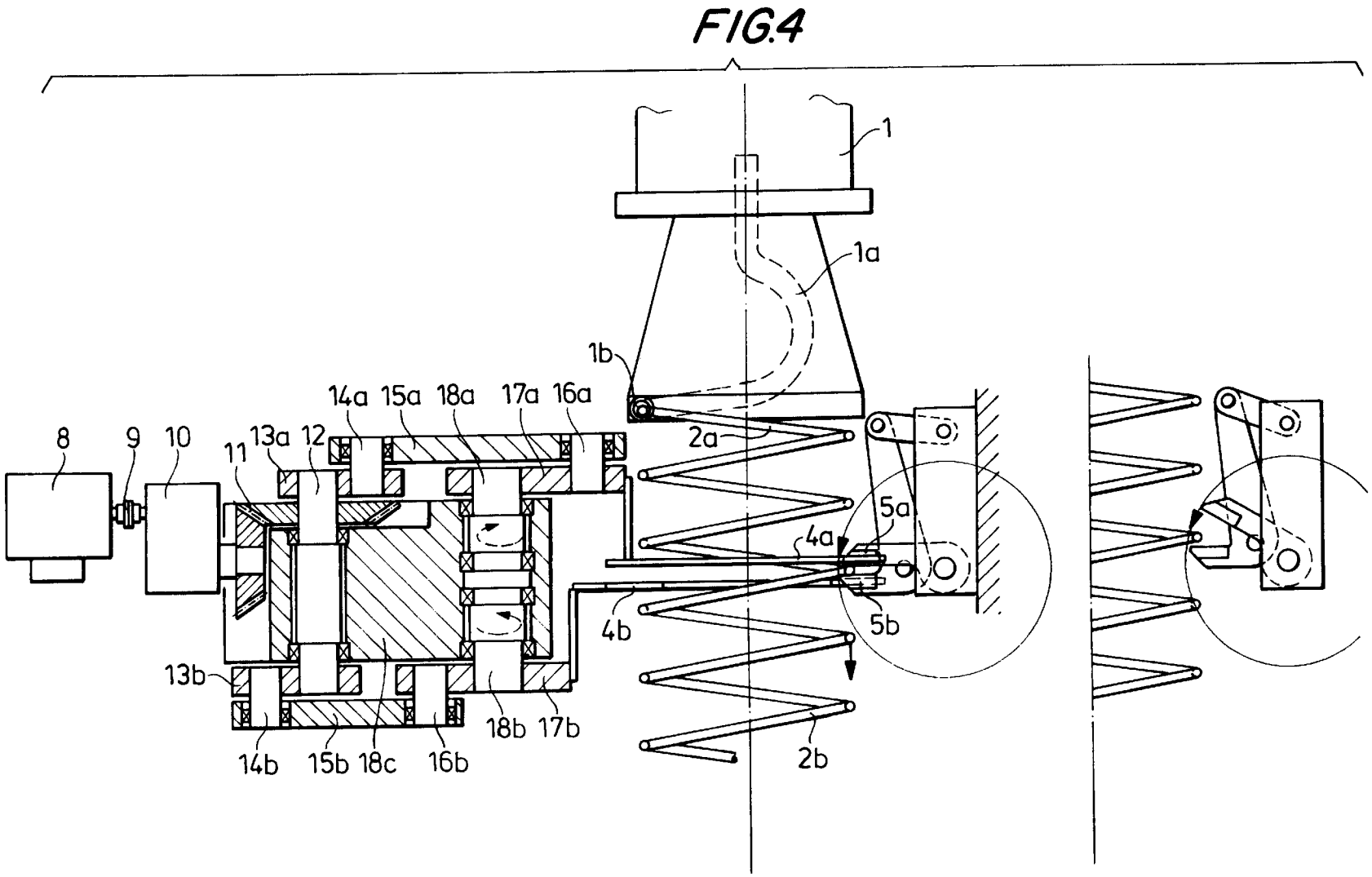
FIG. 4 is a top view of the cutting device.

In the following, an embodiment of the catching arms 4*a*, 4*b* and the drive thereof will be explained in more detail. FIG. 3 shows in a top view two arc-shaped catching arms 4*a*, 4*b* whose curvature corresponds to that of a winding arch. The upper catching arm 4*a* is provided with a semicircular casing 4*c* in order to prevent the last windings from being thrown out. The two catching arms swing into a winding arch and the catching arms swing back after the cutting procedure. The drive for swinging the catching arms is effected by a motor 8, shown in FIG. 4, which drives two eccentric discs 13*a*, 13*b* through a coupling 9 and a gear unit 10 as well as a set of gear wheels 11 through a common drive shaft 12. The eccentric discs 13*a*, 13*b* are connected through bolts 14*a*, 14*b* to a coupling rod 15*a*, 15*b* which, in turn, drives through a bolt 16*a*, 16*b* a second eccentric disc 17*a*, 17*b* which is mounted on the driven shaft 18*a*, 18*b*. The drive shaft and the driven shaft are arranged in a common housing 18*c*. The direction of rotation of the driven shaft 18*a*, 18*b* illustrated in FIG. 4 is the preferred direction when the wire is inclined to the right.

The catching arms 4*a*, 4*b* are fastened to the eccentric disc 17*a*, 17*b* by means of welded connections. Consequently, the first eccentric disc 13*a*, 13*b* forms a unit with the corresponding catching arm 4*a*, 4*b*. The whole arrangement forms a type of crank and rocker system.

It is recommended to arrange an air-cooled or water-cooled protective hood, not shown, between the red-hot wire windings and the drive mechanism.

An embodiment of the drive of the cutting element is shown in FIG. 3. The upper shear element 5*a* has an upper knife 19*a* and the lower shear element 5*b* has a lower knife 19*b*. The drive system once again is a crank and rocker system. The upper element carries out a circular movement. The upper element has an acceleration and deceleration angle of about 270°.

The drive of the shear is effected through a motor 20 and couplings 21 and 22 as well as the gear unit 23. The gear unit 23 drives a shaft 24 which is connected with an eccentric disc 25 as a crank. Fastened to the eccentric disc 25 is the upper knife 19*a* which carries out a circular movement, as also illustrated in FIG. 4. The lower knife 19*b* is fastened to a coupling rod 26. Through the second shaft 27, which is mounted in a common housing 28 with the shaft 24, the coupling rod 26 is guided by a swinging member 29.

If required, the shaft 27 and the swinging member 29 in the form of an eccentric disc may be arranged on the other side of the coupling rod 26, as shown in FIG. 3 in broken lines. In this embodiment, an additional housing 30 is required. This embodiment has been found to be advantageous especially if little space is available.

In addition, the space between the catching arms on the drive side as well as between the catching arms and the shear on the shear side is to be as small as possible, so that the residual windings are not bent or only slightly bent when impinging on the catching arms.

In the following, the method according to the present invention will be described.

A sensor in the form of a photocell 32 is arranged following the finishing block of a rolling mill. When dimensional inaccuracies of the wire are detected, the photocell produces a signal through a time relay depending on the length to be cut. After waiting for the next zero position of the winding layer 1, a time relay each produces a command for the beginning of the movement and the speed of the catching arms 4*a*, 4*b* and the shear elements 5*a*, 5*b*. A control unit 31 selects the point in time for the beginning of the movement and the speed of the catching arms 4*a*, 4*b* and the shear elements 5*a*, 5*b* in such a way that the catching arms and the shear elements are swung or moved between the last correct wire winding and the first scrap winding. The wire is contacted only shortly before the beginning of the cut, as is apparent from the catching and cutting position of the shear in FIG. 4. At the beginning of the cut, the speed of the upper knife corresponds approximately to the horizontal speed of the wire windings, so that the wire is influenced as little as possible by the shear. During the cutting process, the upper knife 19*a* first contacts the wire. The movements of the upper and lower knives 19*a,* 19*b* and of the upper and lower shear elements 5*a,* 5*b* are illustrated more clearly in FIG. 4 in the cutting position and in the catching position.

While specific embodiments of the invention have been shown and described in detail to illustrate the inventive principles, it will be understood that the invention may be embodied otherwise without departing from such principles.

We claim:

1. A device for cutting a continuously moving wire emerging as windings from a winding layer, the device comprising catching means for a winding arch, means for cutting the winding arch and means for controlling a sequence of movements of the catching means and the cutting means, wherein the catching means and the cutting means are arranged immediately following the winding layer, wherein the catching means comprises two catching arms configured to be pivotable toward each other and apart from each other, wherein the catching arms are arranged offset relative to each other by a distance in a winding laying direction, and wherein the distance between the arms is equal to an angle of inclination of a wire winding.

2. The device according to claim 1, wherein the two catching arms include an upper catching arm, and wherein the upper catching arm has a semicircular casing for catching outwardly thrown windings.

3. The device according to claim 1, further comprising sensors for activating the means for controlling, wherein the sensors are mounted in process units in front of the winding layer or at the winding layer.

4. The device according to claim 3, wherein the sensors are photocells.

5. The device according to claim 1, wherein the two catching arms are mounted so as to carry out a swinging movement.

6. The device according to claim 5, wherein the swinging movement of the catching arms is effected by an eccentric system for converting a rotary movement to a swinging movement.

7. The device according to claim 1, wherein the cutting means comprises a shear for cutting the winding arch at a location not supported by the catching means.

8. The device according to claim 7, wherein the shear comprises an upper shear element with an upper knife and a lower shear element with a lower knife, wherein the upper shear element is configured to carry out a circular movement with the upper knife.

9. The device according to claim 8, wherein a drive of the shear is a crank and rocker system.

* * * * *